US009116470B2

(12) United States Patent
Shirafuji et al.

(10) Patent No.: US 9,116,470 B2
(45) Date of Patent: Aug. 25, 2015

(54) ADJUSTMENT OF IMAGE DENSITY, USING A DENSITY ADJUSTMENT CONDITION, IN IMAGE FORMING APPARATUS

(75) Inventors: Yasuhito Shirafuji, Kashiwa (JP); Tomohisa Itagaki, Abiko (JP); Nobuhiko Zaima, Kashiwa (JP); Takahiro Ishihara, Maebashi (JP)

(73) Assignee: CANON KABUSHIKI KAISHA (JP)

( * ) Notice: Subject to any disclaimer, the term of this patent is extended or adjusted under 35 U.S.C. 154(b) by 299 days.

(21) Appl. No.: 13/563,133

(22) Filed: Jul. 31, 2012

(65) Prior Publication Data

US 2013/0034359 A1 Feb. 7, 2013

(30) Foreign Application Priority Data

Aug. 1, 2011 (JP) ..... 2011-168712

(51) Int. Cl.
*G03G 15/00* (2006.01)
*G03G 15/16* (2006.01)
*G03G 15/01* (2006.01)

(52) U.S. Cl.
CPC ..... *G03G 15/161* (2013.01); *G03G 15/0131* (2013.01); *G03G 15/5058* (2013.01); *G03G 2215/00059* (2013.01)

(58) Field of Classification Search
CPC ..... G03G 15/161; G03G 15/5058; G03G 15/0131; G03G 15/00059
USPC ..... 399/49, 72, 74
See application file for complete search history.

(56) References Cited

U.S. PATENT DOCUMENTS 5,963,756 A * 10/1999 Sakai et al. ..... 399/39
6,564,021 B1 5/2003 Nakai et al.
2004/0091277 A1 5/2004 Miyamoto et al.
2005/0025510 A1* 2/2005 Yamada et al. ..... 399/49
2005/0063721 A1 3/2005 Nakayama et al.
2010/0021193 A1 1/2010 Kojima
2011/0182605 A1 7/2011 Otsuka et al.
2011/0304885 A1 12/2011 Unno

FOREIGN PATENT DOCUMENTS

CN 1499306 A 5/2004
CN 101162378 A 4/2008
CN 101634824 A 1/2010
JP 2001042613 A 2/2001
JP 2003338938 A * 11/2003 ..... H04N 1/46
JP 2007-189278 A 7/2007

OTHER PUBLICATIONS

Chinese Office Action dated Jul. 31, 2014 issued in corresponding Chinese Application No. 201210271593.6. English translation provided.
Korean Office Action cited in Korean counterpart application No. KR10-2012-0083619, dated Jun. 17, 2014.

* cited by examiner

*Primary Examiner* — Billy Lactaoen
(74) *Attorney, Agent, or Firm* — Rossi, Kimms & McDowell LLP

(57) ABSTRACT

An image forming apparatus configures a normal transfer potential in a yellow primary transfer unit, and configures a transfer potential which does not cause any retransfer phenomenon of a yellow measurement image in image carriers located on the downstream side of the yellow primary transfer unit. When a color difference obtained from a reference density and a density of a measurement image on an intermediate transfer belt becomes equal to or larger than a prescribed value, the image forming apparatus determines that multinary-color density adjustment is required.

8 Claims, 13 Drawing Sheets

ADJUSTMENT OF IMAGE DENSITY, USING A DENSITY ADJUSTMENT CONDITION, IN IMAGE FORMING APPARATUS

BACKGROUND OF THE INVENTION

1. Field of the Invention

The present invention relates to adjustment of an image density in an image forming apparatus.

2. Description of the Related Art

In a multi-color image forming apparatus, color densities of formed images of respective colors have changed from target densities and the formed images tints may change over time. To address this problem, the image forming apparatus forms a test pattern, measures amounts of applied toners using an internally attached sensor, and adjusts various parameters to attain desired densities.

According to Japanese Patent Laid-Open No. 2007-189278, a method of adjusting density changes of secondary colors has been proposed. More specifically, Japanese Patent Laid-Open No. 2007-189278 has proposed a color tone adjustment apparatus, which outputs a test chart including secondary colors, reads the test chart using a reading unit to grasp density variations of the secondary colors, and adjusts parameters associated with densities. Note that the secondary color means a color formed by superposing two types of toners (for example, yellow and magenta toners) of different colors. A ternary color means a color formed by superposing three types of toners (for example, yellow, magenta, and cyan toners) of different colors. These colors will be collectively referred to as multinary colors hereinafter.

However, with the invention of Japanese Patent Laid-Open No. 2007-189278, the test pattern has to be formed on a printing medium so as to detect the density changes of the secondary colors. Also, the necessity of the density adjustment is visually judged by the user. That is, the user has to control a copying machine to execute a print operation periodically or at an arbitrary timing, and has to judge whether or not to require the density adjustment by checking an image printed on the printing medium.

SUMMARY OF THE INVENTION

The present invention reduces the load on the user while suppressing consumption of printing media associated with multinary-color density adjustment.

The present invention provides an image forming apparatus comprising: a first transfer unit configured to transfer a first image using a color material of a first color on a first image carrier to a intermediate transfer body; a second transfer unit located on a downstream side of the first transfer unit in a conveying direction of the intermediate transfer body, configure to transfer a second image using a color material of a second color different from the first color on a second image carrier to the intermediate transfer body; a configuring unit configured to configure a transfer potential to be applied to the second transfer unit; a density detection unit located on the downstream side of the second transfer unit in the conveying direction of the intermediate transfer body, configured to detect a density of a measurement image that is formed on the intermediate transfer body from the first image and uses the color material of the first color; and a creation unit configured to create, based on a result obtained by the density detection unit, a multinary-color density adjustment table used for adjusting a density of an image formed in an image formation using the first color as a lower layer color of a multinary color, wherein when the creation unit creates the multinary-color density adjustment table, the configuring unit configures the transfer potential to be applied to the second transfer unit to a transfer potential which prevents the measurement image transferred by the first transfer unit and using the color material of the first color from being retransferred to the second image carrier.

The image forming apparatus may further comprise additional feature.

Further features of the present invention will become apparent from the following description of exemplary embodiments (with reference to the attached drawings).

DESCRIPTION OF THE EMBODIMENTS

In one embodiment, when toner images of different colors are formed on an image carrier by different transfer potentials, and a difference (color difference) between the amounts of applied toners (to be referred to as applied toner amounts hereinafter) of the toner images of the respective colors on the image carrier is equal to or larger than a prescribed value, it is judged that multinary-color density adjustment is required. Hence, according to this embodiment, the load on the user can be reduced while suppressing consumption of printing media. Note that as the multinary-color density adjustment, an arbitrary adjustment method such as a known or analogous adjustment method can be used.

<Outline of Image Forming Apparatus>

Figure 1:
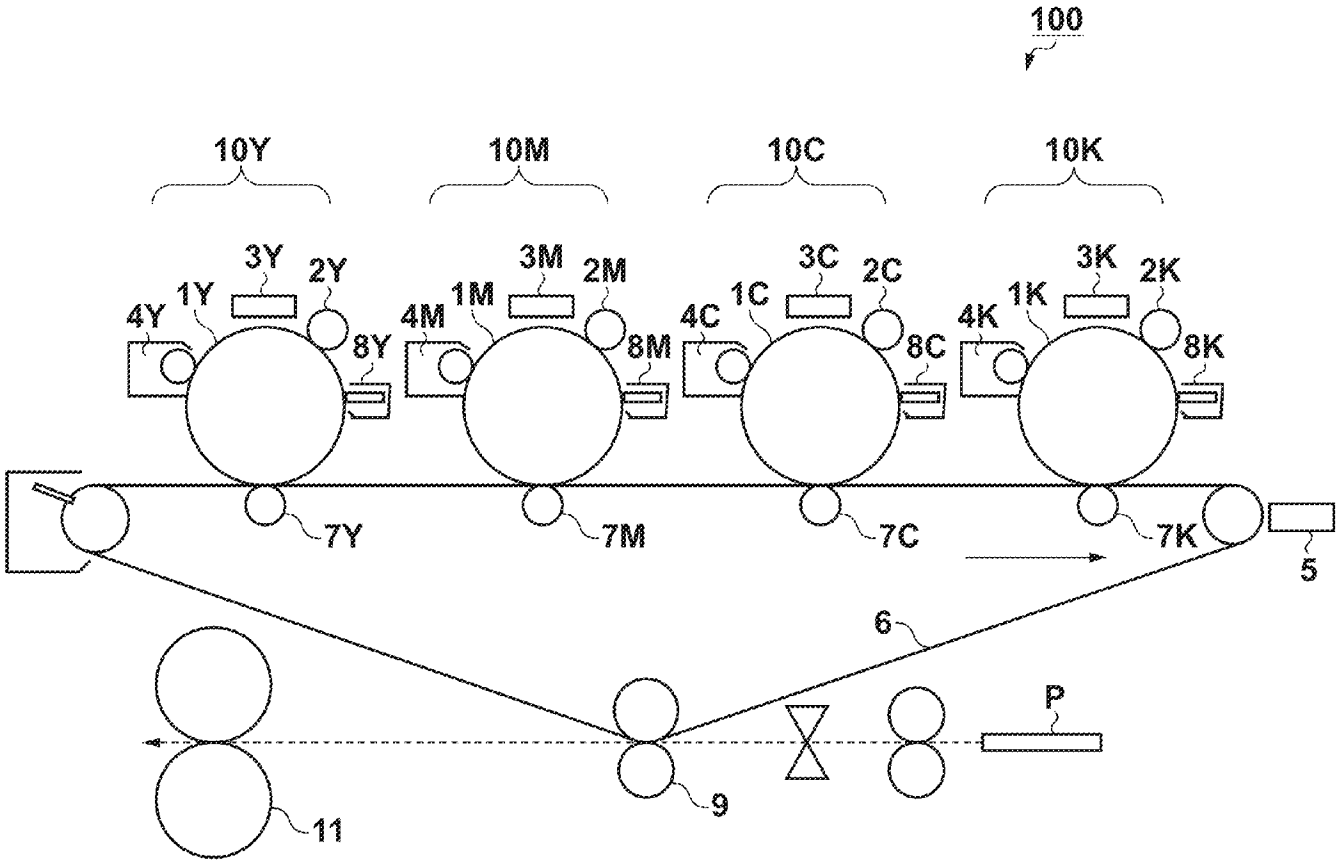
FIG. 1 is a view showing an image forming apparatus.

FIG. 1 is a schematic sectional view of a tandem type multi-color image forming apparatus. An image forming apparatus 100 includes four image forming units 10Y to 10K which respectively form toner images of different colors. Note that Y, M, C, and K attached to reference numerals respectively mean yellow, magenta, cyan, and black. When describing hereinafter elements of the forming apparatus 100 that are common to the forming units 10Y, 10M, 10C, and 10K, explicit indication of Y, M, C, and K on reference numerals 1, 2, 3, 4, 7, 8, 10 will be omitted.

A photosensitive drum 1 is an image carrier which is uniformly charged by a charging device 2. An exposure device 3 forms a latent image by scanning an image forming surface of the photosensitive drum 1 with a light beam having a light amount according to image information. A developing device 4 develops the latent image using a toner to form a toner image. A primary transfer unit 7 includes a roller applied with a predetermined primary transfer potential, and primarily transfers the toner image from the photosensitive drum 1 onto an intermediate transfer belt 6. A drum cleaner 8 cleans the residual toner on the photosensitive drum 1 after the primary transfer of the toner image.

As shown in FIG. 1, the yellow image forming unit 10Y is arranged at the most upstream side in a conveying direction of a toner image. The magenta image forming unit 10M, cyan image forming unit 10C, and black image forming unit 10K are arranged in turn from there toward the downstream side. Hence, on the intermediate transfer belt 6, a yellow toner image is primarily transferred on the lowermost layer, a magenta toner image is primarily transferred on the second lowermost layer, a cyan toner image is primarily transferred on the third lowermost layer, and a black toner image is primarily transferred on the uppermost layer. When a multinary-color toner image is formed using two or more arbitrary toner colors, the toners of the respective colors are superposed in this order.

At a position opposing a toner carrying surface of the intermediate transfer belt 6, a density detection sensor 5, which detects densities (applied toner amounts) of measurement images (patch images) formed on this intermediate transfer belt 6, is arranged. The toner image formed on the intermediate transfer belt 6 is transferred onto a printing medium P by a secondary transfer unit 9, and is heated and pressed by a fixing device 11. Thus, the toner image is fixed on the surface of the printing medium P.

<Tint Variation Cause of Multinary Color>

Tint variation causes of a multinary color will be described first. Normally, when each of Y, M, C, and K colors undergoes density adjustment as a single color, the density of a multinary color should be appropriately adjusted. The density adjustment in this case is to create density adjustment tables of Y, M, C, and K colors (to be described later). By adjusting the densities of Y, M, C, and K input images using the corresponding density adjustment tables, the densities of output images match those of input images prior their adjustment. The densities of the input images are those of source images, and the densities of the output images are those of images formed on the printing medium P.

However, degrees of tint variations of multinary colors largely change depending on a phenomenon called retransfer that occurs in the primary transfer unit 7. Therefore, the tendency of the density variations of single colors and that of tint variations of multinary colors are not always same.

Figure 2:
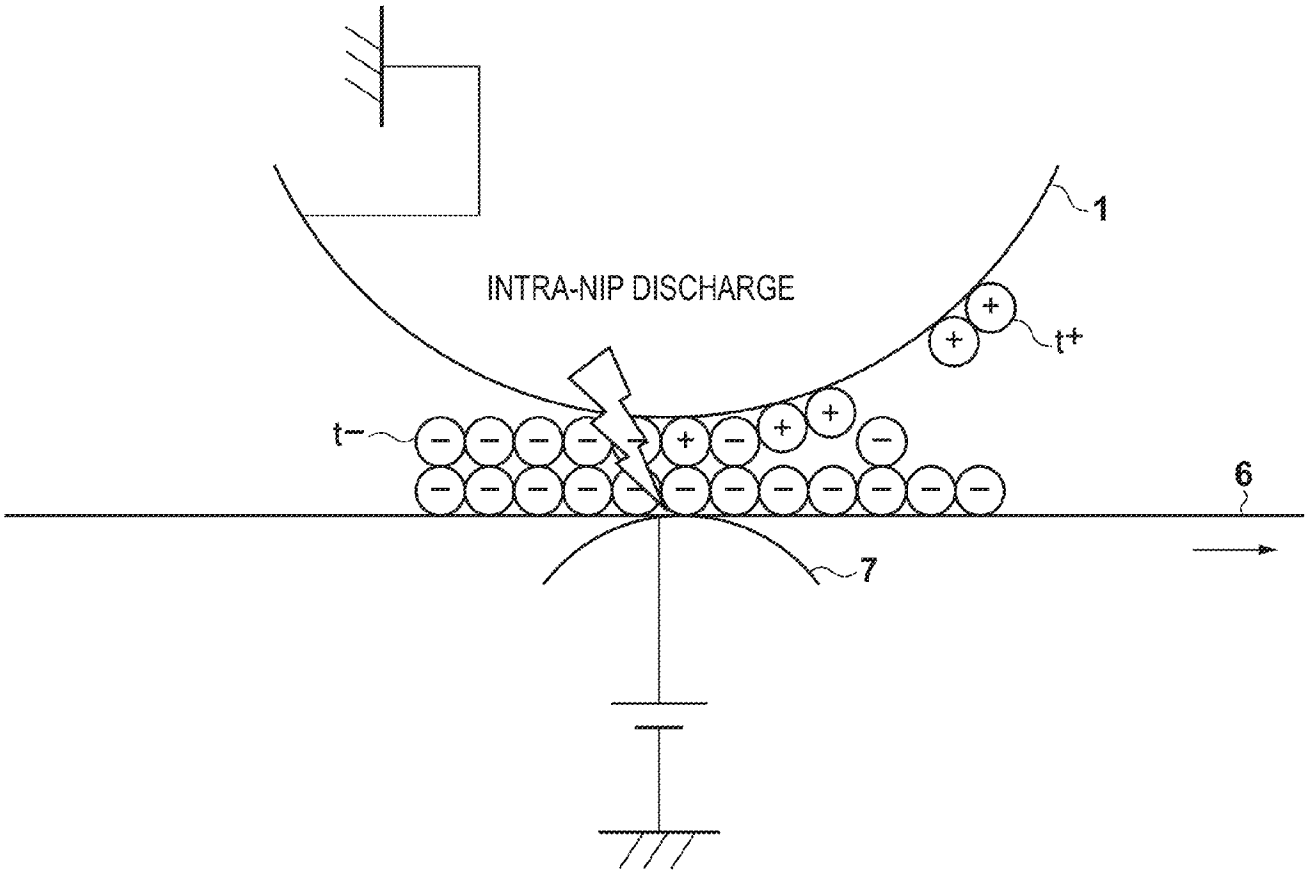
FIG. 2 is a view showing a retransfer phenomenon in a transfer nip portion.

The retransfer phenomenon will be described below with reference to FIG. 2. In the image forming unit 10 on the upstream side in the toner conveying direction, toner particles $t^-$ are transferred from the photosensitive drum 1 onto the intermediate transfer belt 6. The toner particles $t^-$ are conveyed by the intermediate transfer belt 6, and reach a transfer nip portion of the image forming unit 10 on the downstream side in the conveying direction. A transfer electric field which promotes transfer of toner particles exists between the photosensitive drum 1 of the downstream image forming unit 10 and a primary transfer roller of the primary transfer unit 7. On the other hand, this transfer electric field causes a discharge phenomenon. The charge polarity of the toner particles on the intermediate transfer belt 6 is inverted by the discharge phenomenon, thus generating toner particles $t^+$. The toner particles $t^+$ are unwantedly transferred from the intermediate transfer belt 6 onto the photosensitive drum 1 of the downstream image forming unit 10. This phenomenon is called a retransfer phenomenon. When the retransfer phenomenon has occurred, the applied toner amount on the intermediate transfer belt 6 is decreased from an ideal amount, thus causing multinary-color tint variations.

Therefore, in the image forming apparatus 100 in which the Y, M, C, and K image forming units 10Y to 10K are tandemly arranged, the density adjustments of Y, M, and C toners have to be executed in consideration of the retransfer phenomenon. This retransfer amount is largely influenced by a toner charge amount.

Figure 3:
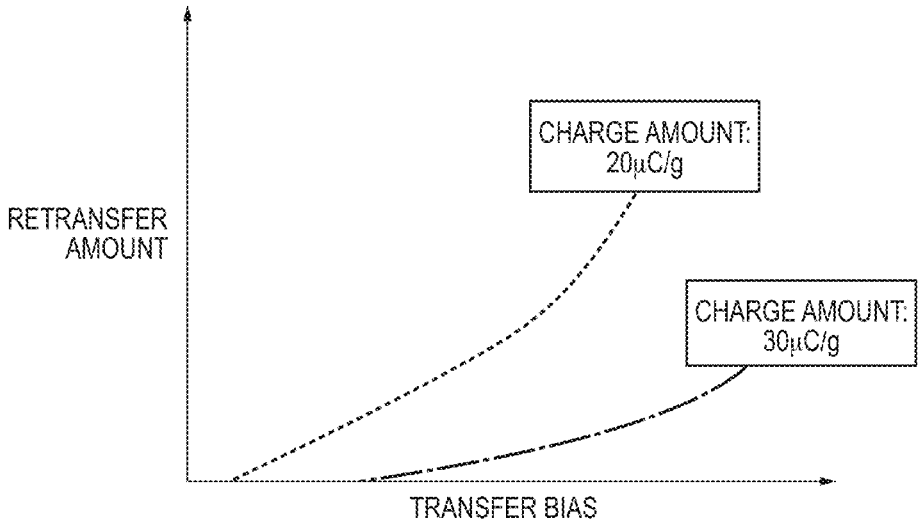
FIG. 3 is a graph showing the relationship between a toner charge amount and retransfer amount.

FIG. 3 shows the relationship between transfer potentials and retransfer amounts in two cases of different toner charge amounts. As shown in FIG. 3, when a toner charge amount is large, since a charge polarity inversion phenomenon hardly occurs in the nip portion, a retransfer amount is small. On the other hand, when a toner charge amount is small, the inversion phenomenon readily occurs, and a retransfer amount increases.

The relationship between multinary-color tint variations and the retransfer phenomenon will be described below. In the density adjustment of each of Y, M, C, and K single colors, the density detection sensor 5 detects the applied toner amount. The density detection sensor 5 is arranged at a position on the downstream side of the most downstream image forming unit 10K in the moving direction of the circumferential surface of the intermediate transfer belt 6 and on the upstream side of the secondary transfer unit 9, as shown in FIG. 1. The aforementioned density adjustment table is created so that the applied toner amount corresponds to a target value.

For example, the density adjustment of a magenta (M) single color will be examined below. The density detection sensor 5 detects the applied toner amount of a magenta toner which has passed the cyan image forming unit 10C and black image forming unit 10K. Hence, the magenta applied toner amount has to be decided in consideration of a toner amount which has been lost due to the retransfer phenomenon.

Figure 4:
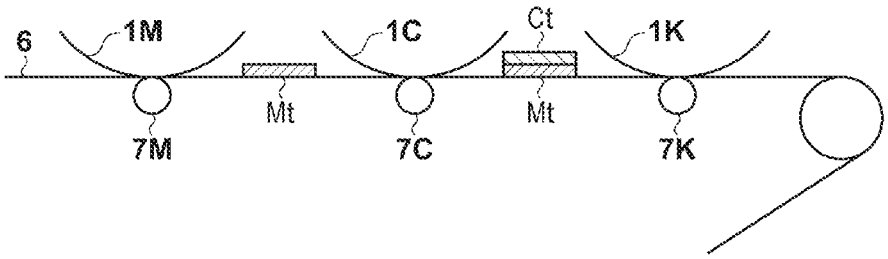
FIG. 4 is a view showing multinary color formation.

On the other hand, in order to form a multinary color, as shown in FIG. 4, a toner layer Ct is superposed by the cyan image forming unit 10C, which is located on the downstream side, on a toner layer Mt formed by the magenta image forming unit 10M. Furthermore, another toner layer may also be superposed by the black image forming unit 10K.

A magenta retransfer amount upon forming blue as an example of a multinary color will be described below. A required amount of magenta toner is transferred onto the intermediate transfer belt 6 by the magenta image forming unit 10M, and is conveyed to the cyan image forming unit 10C. The cyan image forming unit 10C transfers a cyan toner to be superposed on the magenta toner. At this time, the magenta toner is influenced by the transfer electric field of the cyan image forming unit 10C. However, the retransfer amount decreases largely compared to a situation where an image is formed by a magenta toner image as a single color without the superposition of a cyan toner. For example, in the case of a solid blue color, the retransfer amount of the magenta toner in the cyan image forming unit 10C is almost zero. This is because a solid cyan image is transferred onto a solid magenta image, as shown in FIG. 4. In this manner, the single-color density variations are considerably influenced by the retransfer phenomenon, and the multinary-color tint variations are not so influenced by the retransfer phenomenon.

When actually adjusting single-color density, since an applied toner amount is adjusted by recognizing the applied toner amount of a single color on the intermediate transfer belt 6, a loss of the applied toner amount due to the retransfer phenomenon is taken into consideration.

However, the retransfer amount changes due to change of the toner charge amount.

For example, when low-density Y, M, and C images are continuously output, as the number of formed images becomes larger, the toner charge amount changes from the target charge amount. When a low-density image is formed, a retaining time of toner particles in the developing device 4 becomes longer, and the number of times of friction of toner particles increases, and the toner charge amount is increased (charged up) to be larger than the target charge amount. When the toner charge amount becomes larger than the target charge amount, the retransfer amounts in the image forming units 10C and 10K located on the downstream side of, for example, a magenta toner decrease, as shown in FIG. 3. Then, when the density adjustment (applied toner amount adjustment) is started at a certain timing after the toner charge amount became larger than the target charge amount, the density detection sensor 5 detects the density of a magenta patch image formed based on the same parameter configurations as those at those set at the initial stage. But now that the toner charge amount has changed causing a decrease in retransfer amount, the sensor 5 detects an increase in applied toner amount on the intermediate transfer belt 6. As a result, the image forming apparatus 100 reduces the applied toner amount in the magenta image forming unit 10M. At the same time, the image forming apparatus 100 also reduces the applied toner amount of a magenta toner in association with a multinary color. This is because the applied toner amount of one given color when forming a multinary color image is determined from the result of the application of a single-color adjustment method corresponding to that one given color. It is indeed considered that toner amount adjustment of a multinary color image results from individual execution of single-color toner amount adjustment methods for one or more of the colors forming the multinary color image.

However, in practice, a toner, which is located on a lower layer, of a plurality of toners of different colors that form a multinary color is nearly not influenced by the retransfer amount due to a change in toner charge amount. Therefore, when the applied toner amount adjustment of a multinary color is executed according to the single-color applied toner amount adjustment result as stated above, the applied toner amounts in the multinary color run short.

Figure 5:
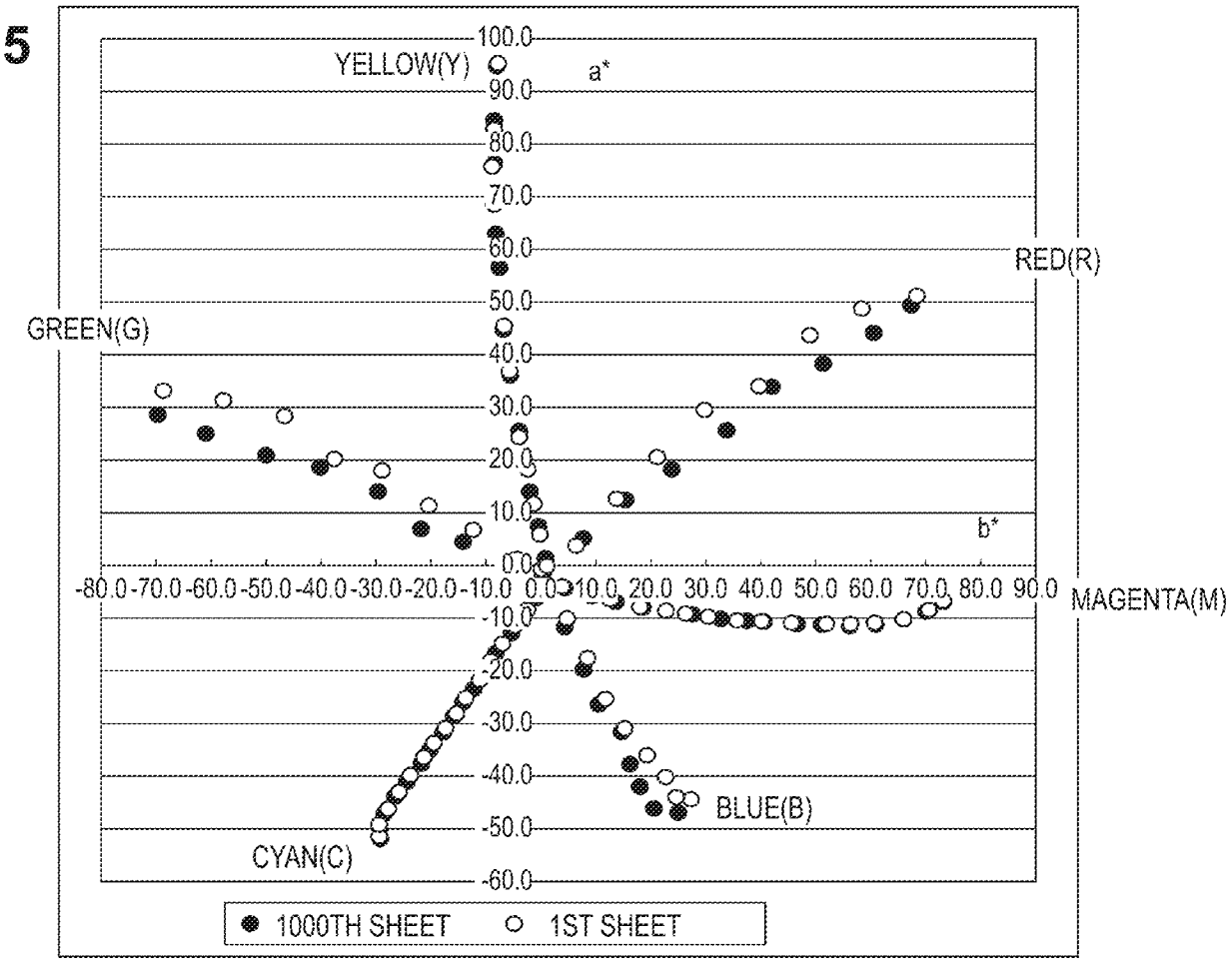
FIG. 5 is a graph showing chromaticity points of the first and 1000th sheets when an image is continuously output at a low print ratio.

FIG. 5 shows measurement results of Y, M, C, K, R (RED), G (GREEN), and B (BLUE) chromaticity points of the first and 1000th sheets when images of Y, M, C, and K colors are continuously output onto 1000 sheets at a density of 5%. As can be seen from FIG. 5, chromaticity points of single colors (Y, M, and C) are roughly the same on the first and 1000th sheets. However, chromaticity points of multinary colors such as blue, red, and green are different on the first and 1000th sheets. In blue and green, chromaticity points are shifted toward the cyan side. Hence, as can be understood from the above description, yellow and magenta applied toner amounts are reduced. In red as well, since a yellow applied toner amount is reduced in the yellow image forming unit 10Y located at the more upstream position, chromaticity points are shifted toward the magenta side. The charge amounts of a magenta toner on the first and 1000th sheets and the retransfer amounts in the cyan image forming unit 10C at that time were checked in practice. As a result, the toner charge amounts were charged up from 20 μC/g to 30 μC/g, and the retransfer amounts were decreased.

Conventionally, unless a multinary-color test pattern is formed on a printing medium in practice and the user or the like visually confirms that pattern, multinary-color tint variations cannot be recognized. Hence, in this embodiment, toner images of different colors are respectively formed on the image carrier by different transfer potentials, and applied toner amounts of the toner images of the respective colors on the image carrier are measured and compared to each other. When a difference calculated from the applied toner amounts of the toner images of the respective colors on the image carrier exceeds a prescribed value, it is judged that multinary-color density adjustment is required. Hence, in this embodiment, the load on the user can be reduced while suppressing consumption of printing media.

<Control Block>

Figure 6:
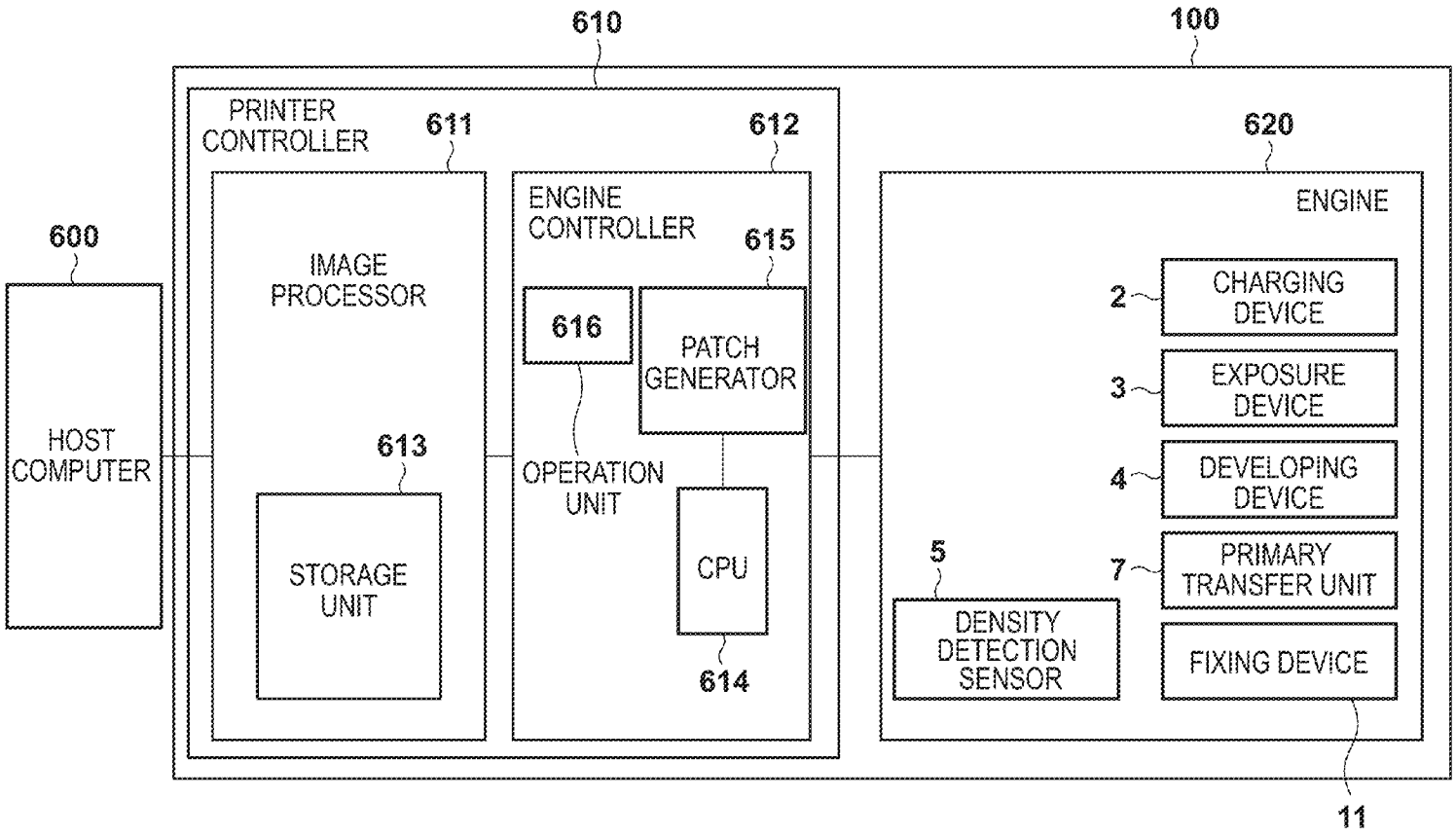
FIG. 6 is a block diagram showing control blocks.

FIG. 6 is a control block diagram of this embodiment. The image forming apparatus 100 forms an image according to a print job received from a host computer 600. A printer controller 610 includes an image processor 611 and engine controller 612. The image processor 611 converts a color space of image data attached to the print job into image data (density data) of a color space of toner colors. Furthermore, the image processor 611 reads out density adjustment tables corresponding to Y, M, C, and K density data from a storage unit 613, and adjusts respective density data. The density adjustment tables are, for example, lookup tables used to apply gamma adjustment. As the density adjustment tables, those used at a single-color image forming timing and those used at a multinary-color image forming timing are prepared in correspondence with Y, M, and C colors.

The engine controller 612 includes a CPU 614 used to control various parameters related to image formation, and a patch generator 615 used to generate image data of patch images. The engine controller 612 further includes an operation unit 616 having a display device and input device. The operation unit 616 functions as a user interface for the user. An engine 620 includes the aforementioned primary transfer units 7, density detection sensor 5, and the like.

The CPU 614 controls the patch generator 615 to generate image data of patch images, and supplies them to the exposure devices 3 of the engine 620. The exposure devices 3 form latent images of the patch images on the photosensitive drums 1. The latent images are developed by the developing devices 4 to obtain toner images. The toner images are primarily transferred onto the intermediate transfer belt 6 by the primary transfer units 7 applied with a transfer potential configured by the CPU 614. Especially, the CPU 614 measures the densities (applied toner amounts) of patch images respectively formed using two types of primary transfer potentials. When a difference between these densities exceeds a prescribed value, it is determined that the adjustment of the applied toner amounts of a multinary color (density adjustment) is required.

<Outline of Density Detection Sensor>

Figure 7:
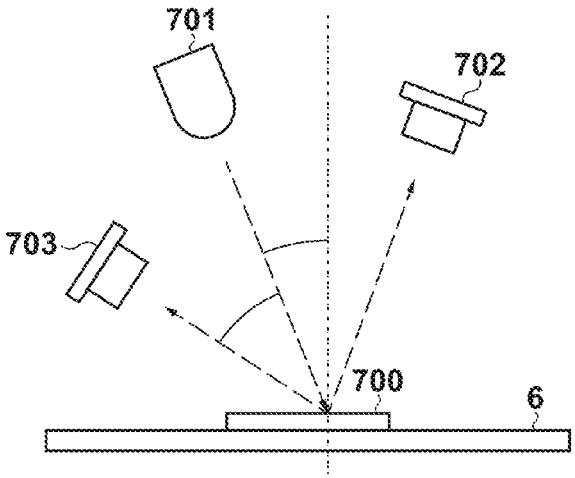
FIG. 7 is a view showing a density detection sensor.

The density detection sensor 5 includes, for example, a light-emitting element 701, a light-receiving element 702 adapted to receive specular reflected light, and a light-receiving element 703 adapted to receive diffuse reflected light, as shown in FIG. 7. Light emitted by the light-emitting element 701 is reflected by a toner layer 700 on the intermediate transfer belt 6. The light-receiving element 702 receives specular reflection light components of reflection light from the toner layer 700, and outputs a voltage according to the received light amount. Likewise, the light-receiving element 703 receives diffuse reflection light components of the reflection light from the toner layer 700, and outputs a current according to the received light amount.

Note that other sensors may be used as long as the applied toner amount on the intermediate transfer belt 6 can be recognized. For example, the density detection sensor 5 including two light-emitting elements and one light-receiving element may be used. An emission wavelength of the light-emitting element 701 may fall within a range from, for example, about 800 nm to 850 nm in consideration of reflectance characteristics of toners. The emission wavelength of the light-emitting element 701 is decided according to the reflectance characteristics of toners.

In this embodiment, in order to detect the density of a high-density part, the diffuse reflection light components received by the diffuse reflection light light-receiving element 703 are used. Note that the black toner absorbs light, and diffuse reflection light components become very small. Hence, specular reflection light components are used for the black toner. Note that when the density is detected using specular reflection light components for the black toner, the detection precision of a high-density part lowers, but it does not pose a serious problem in this embodiment. This is because it is important in this embodiment to recognize the yellow, magenta, and cyan applied toner amounts whose retransfer phenomena pose a problem.

<Density Detection Operation>

Figure 8:
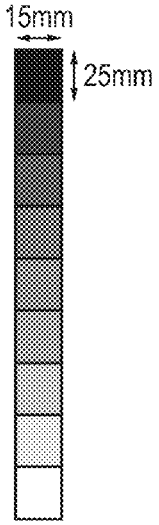
FIG. 8 is a view showing measurement images (patch images)

Density detection using the density detection sensor 5 will be described below. In this embodiment, when the density adjustment is started, the image forming apparatus 100 forms nine patch images having nine different density levels, as shown in FIG. 8. Each patch image has a size of 15 mm in the main scan direction, and 25 mm in the sub-scan direction as an image moving direction.

Figure 9:
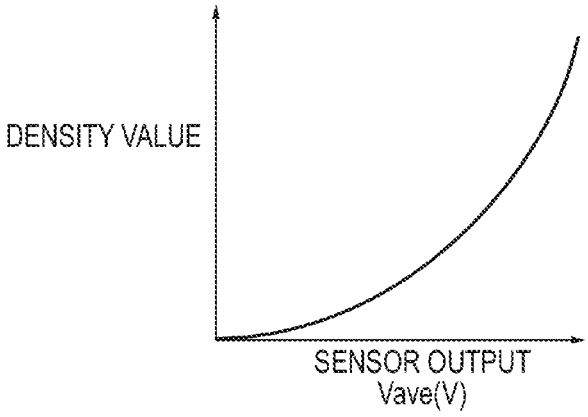
FIG. 9 shows an example of a sensor output/density value conversion table.

The density detection sensor 5 measures densities at a total of 25 points every 2 ms, and outputs measurement values to the CPU 614. The CPU 614 calculates an average value of the measurement values of 23 points which remain after maximum and minimum values are excluded from the measurement values of the points. The CPU 614 converts an average value Vave into density information using a sensor output/density conversion table. FIG. 9 shows an example of the sensor output/density conversion table. The sensor output/density conversion table is created in advance at a factory delivery timing in consideration of individual differences of the density detection sensors 5, and is stored in a nonvolatile memory included in the engine controller 612.

<Determination of the Necessity of Multinary Color Density Adjustment>

In this embodiment, the engine controller 612 not only executes the density adjustment of yellow, magenta, cyan, and black single colors, but also judges whether or not the multinary-color density adjustment is required by detecting multinary-color tint variations. Especially, this embodiment is characterized in that each primary transfer unit 7 uses different transfer potentials in correspondence with a case in which the applied toner amount of a single color is to be recognized and a case in which that of a multinary color is to be recognized.

The CPU 614 configures a transfer potential of a normal image forming mode in the primary transfer units 7 when the CPU 614 recognizes the applied toner amount of a single color. Also, the CPU 614 configures a transfer potential of a downstream image forming unit of the plurality of image forming units related to a multinary color to be a predetermined value (for example, 0 volt) when the CPU 614 recognizes the applied toner amount of the multinary color. In the normal image forming mode, an image is formed on the printing medium P according to a print job received from the host computer 600.

For example, when the applied toner amount of a multinary color which requires a yellow toner is to be recognized, primary transfer potentials of the magenta, cyan, and black image forming units are configured to be 0 volt. When the applied toner amount of a multinary color which requires a magenta toner is to be recognized, primary transfer potentials of the cyan and black image forming units are configured to be 0 volt. Furthermore, when the applied toner amount of a multinary color which requires a cyan toner is to be recognized, a primary transfer potential of the black image forming unit is configured to be 0 volt.

Figure 10:
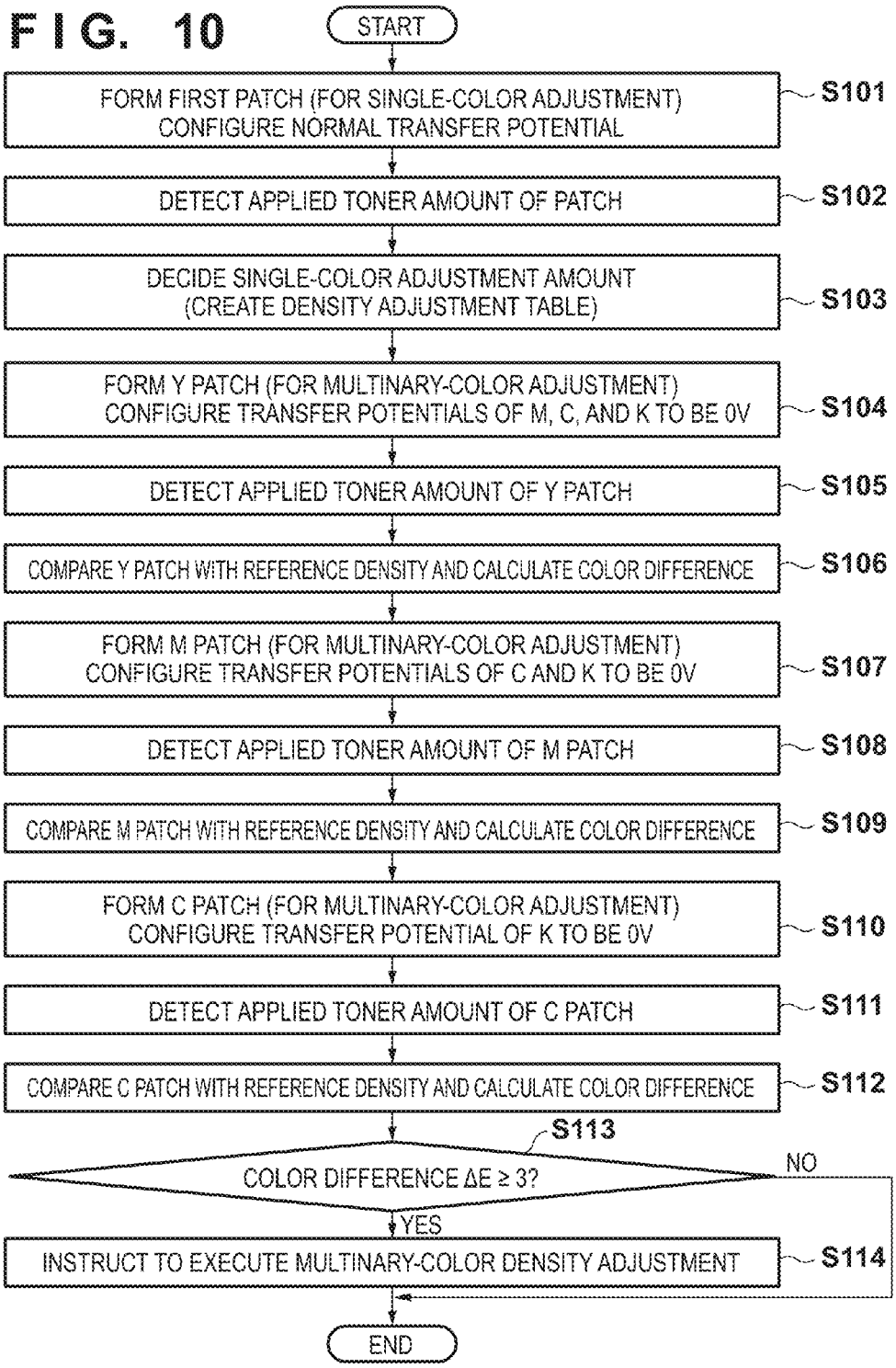
FIG. 10 is a flowchart showing density adjustment processing.

FIG. 10 is a flowchart showing the density adjustment sequence executed by the CPU 614. The density adjustment of a magenta toner single color and that of a multinary color that requires a magenta toner will be exemplified below with reference to FIGS. 1 and 6. When density adjustment start conditions are satisfied, the CPU 614 starts the density adjustment shown in FIG. 10. The density adjustment start conditions include, for example, a start instruction input by the user, the number of image formed sheets which has reached a prescribed value, and the like.

In step S101, the CPU 614 controls the patch generator 615 to generate image data of patch images required to execute the density adjustment of Y, M, C, and K single colors, and passes them to the exposure devices 3 of the engine 620. The CPU 614 configures a normal transfer potential Vn in the magenta, cyan, and black primary transfer units 7M, 7C, and 7K. The normal transfer potential Vn is that to be configured upon execution of a print job. The CPU 614 controls the charging devices 2, exposure devices 3, developing devices 4, and primary transfer units 7 to form the patch images shown in FIG. 8 on the intermediate transfer belt 6. The patch images primarily transferred by the upstream image forming unit pass the downstream image forming units, and reach the density detection sensor 5. For example, a yellow toner image passes the magenta, cyan, and black image forming units 10M, 10C, and 10K.

In step S102, the CPU 614 controls the density detection sensor 5 to detect the densities of the patch images on the intermediate transfer belt 6. More specifically, when the patch images are conveyed to the position of the density detection sensor 5, the density detection sensor 5 irradiates the patch images with light of a wavelength of 850 nm, and receives the reflection light. The light of the wavelength of 850 nm is used for all colors. The CPU 614 converts the output result (average value Vave) of the density detection sensor 5 into density information using the table shown in FIG. 9.

Figure 11:
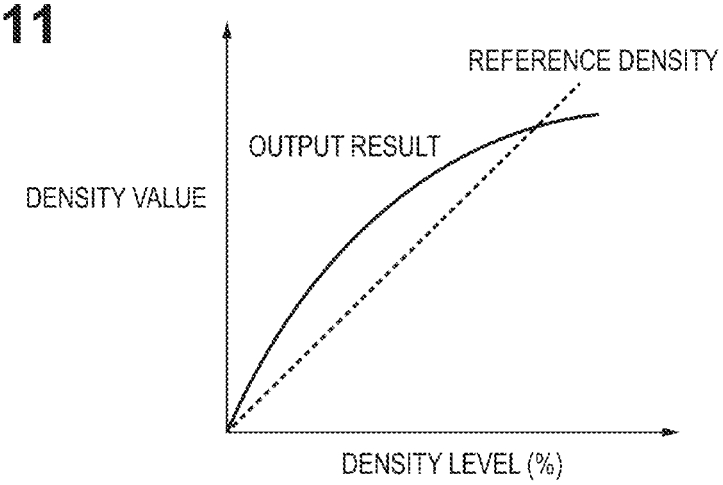
FIG. 11 is a graph showing an example of density characteristics.
Figure 12:
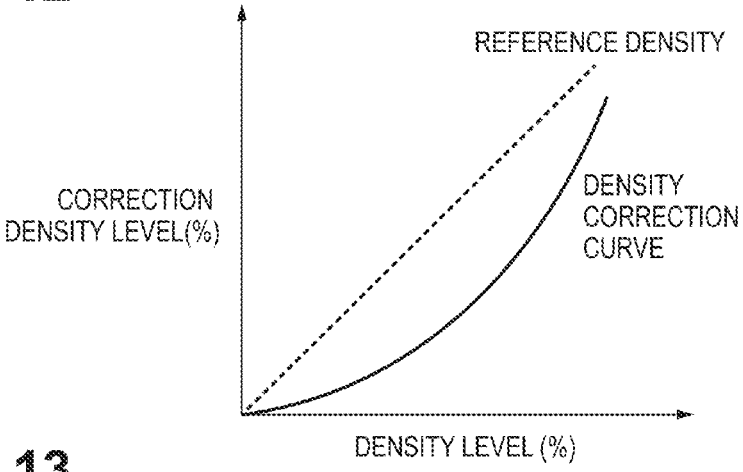
FIG. 12 shows an example of a density adjustment table.

In step S103, the CPU 614 creates a density adjustment table (γLUT) based on the density information and stores that table in the storage unit 613 of the image processor 611. More specifically, the CPU 614 obtains current density characteristics with respect to density levels (input density levels) of the image data of the patch images based on the measured density values. For example, assume that the obtained current density characteristics are entirely higher than prescribed density characteristics, as shown in FIG. 11. The CPU 614 creates a linear density adjustment table (γLUT) shown in FIG. 12, so that the output result fits the prescribed density characteristics. The density adjustment table which makes the current density characteristics shown in FIG. 11 closer to the prescribed density characteristics is that of a density adjustment curve, as indicated by the solid curve in FIG. 12. When a normal image is formed, the image processor 611 reads out this table from the storage unit 613, and converts an input density into an output density.

In this way, when the CPU 614 creates a single-color density adjustment table used to form an image using a first color as a single color, it configures the transfer potential Vn used upon execution of an image forming job as a first transfer potential applied to a upstream side of a primary transfer unit and a second transfer potential applied to a downstream side of another primary transfer unit. Furthermore, the CPU 614 creates a single-color density adjustment table used to convert a density detected by the density detection sensor 5 of a patch image using a color material of the first color.

Next, multinary-color density variations are recognized. In order to recognize density variations due to a change in retransfer amount, this embodiment focuses attention on the image forming units 10Y to 10C other than the black image forming unit 10K located at the most downstream position. This is because no image forming unit which causes any retransfer phenomenon exists between the black image forming unit 10K and density detection sensor 5. Note that if an image forming unit which is located at the most downstream position is one of yellow, magenta, and cyan image forming units, a retransfer phenomenon for that color never occurs. For this reason, the density adjustment need not be executed for a toner of the image forming unit located at the most downstream position. In this manner, this embodiment recognizes the necessity of the density adjustment when yellow, magenta, and cyan toner images influenced by the retransfer phenomenon are formed as lower layers upon formation of a multinary-color image.

In step S104, the CPU 614 controls the patch generator 615 to generate image data of a yellow patch image, and passes it to the exposure device 3Y of the engine 620. The patch image is as shown in FIG. 8. The CPU 614 configures the normal transfer potential Vn in the yellow primary transfer unit 7Y, and configures a transfer potential V0 in the magenta, cyan, and black primary transfer units 7M, 7C, and 7K on the downstream side of the yellow primary transfer unit. The transfer potential V0 is, for example, 0 volt. In this manner, the primary transfer unit 7Y is an example of a first transfer unit which transfers an image using a color material of a first color on an image carrier by a first transfer potential. Each of the magenta, cyan, and black primary transfer units 7M, 7C, and 7K is an example of a second transfer unit which is located on the downstream side of the first transfer unit in the conveying direction of an image, and transfers, on the image carrier, an image using a color material of a second color different from the first color by a second transfer potential. The CPU 614 is an example of a configuring unit which configures the first and second transfer potentials.

Figure 13:
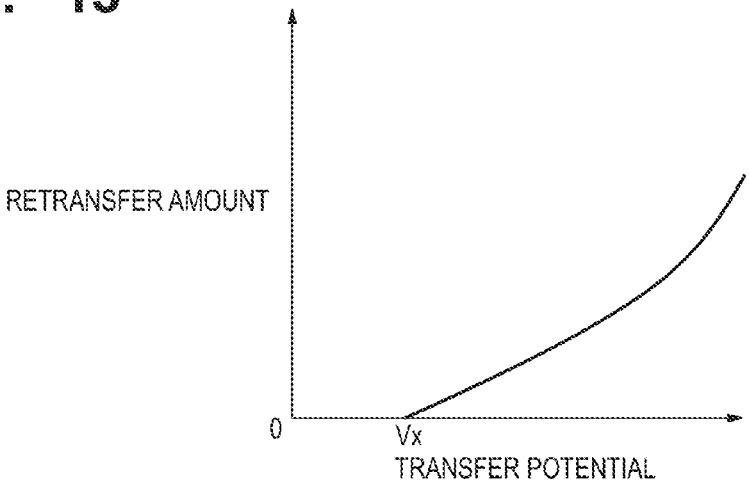
FIG. 13 is a graph showing the relationship between a transfer potential and retransfer amount.

The transfer potential has retransfer characteristics, as shown in FIG. 13. That is, when the transfer potential falls within a range from 0 volt to Vx, the retransfer amount becomes zero. In case of the retransfer characteristics shown in FIG. 13, the transfer potential V0 can be configured to fall within a range from 0 volt to Vx. In this case, V0=0 for the sake of simplicity. Thus, the yellow patch image is formed on the intermediate transfer belt 6, and is conveyed to the detection position of the density detection sensor 5. As a characteristic feature in this case, toner images of a multinary color are not formed on the intermediate transfer belt 6.

In step S105, the CPU 614 controls the density detection sensor 5 in order to detect the density of the yellow patch image on the intermediate transfer belt 6. The measurement values of the density detection sensor 5 are converted into a density value by the aforementioned sequence. In this manner, the density detection sensor 5 is an example of a density detection unit which is located on the downstream side of the second transfer unit in the conveying direction of an image, and detects a density of a patch image which is formed on the image carrier and uses the color material of the first color.

In step S106, the CPU 614 compares the density value of the yellow patch image with a reference density value, and calculates a color density difference ΔY from the reference density value. In this manner, the CPU 614 obtains a color difference from the density, detected by the density detection sensor 5, of the patch image using the color material of the first color.

In step S107, the CPU 614 controls the patch generator 615 to generate image data of a magenta patch image, and passes it to the exposure device 3M of the engine 620. The patch image is as shown in FIG. 8. The CPU 614 configures the normal transfer potential Vn in the magenta primary transfer unit 7M, and configures the transfer potential V0 in the cyan and black primary transfer units 7C and 7K on the downstream side of the magenta primary transfer unit. Thus, the magenta patch image is formed on the intermediate transfer belt 6, and is conveyed to the detection position of the density detection sensor 5. The magenta patch image is also a single-color patch image. In this manner, the primary transfer unit 7M is an example of the first transfer unit which transfers an image using the color material of the first color on the image carrier by the first transfer potential. Each of the cyan and black primary transfer units 7C and 7K is an example of the second transfer unit which is located on the downstream side of the first transfer unit in the conveying direction of an image, and transfers, on the image carrier, an image using the color material of the second color different from the first color by the second transfer potential.

In step S108, the CPU 614 controls the density detection sensor 5 to detect the density of the magenta patch image on the intermediate transfer belt 6. The measurement values of the density detection sensor 5 are converted into a density value by the aforementioned sequence.

In step S109, the CPU 614 compares the density value of the magenta patch image with a reference density value, and calculates a color density difference ΔM from the reference density value.

In step S110, the CPU 614 controls the patch generator 615 to generate image data of a cyan patch image, and passes it to the exposure device 3C of the engine 620. The patch image is as shown in FIG. 8. The CPU 614 configures the normal transfer potential Vn in the cyan primary transfer unit 7C, and configures the transfer potential V0 in the black primary transfer unit 7K on the downstream side of the cyan primary transfer unit. Thus, the cyan patch image is formed on the intermediate transfer belt 6, and is conveyed to the detection position of the density detection sensor 5. The cyan patch image is also a single-color patch image. In this manner, the primary transfer unit 7C is an example of the first transfer unit which transfers an image using the color material of the first color on the image carrier by the first transfer potential. The black primary transfer unit 7K is an example of the second transfer unit which is located on the downstream side of the first transfer unit in the conveying direction of an image, and transfers, on the image carrier, an image using the color material of the second color different from the first color by the second transfer potential.

In step S111, the CPU 614 controls the density detection sensor 5 to detect the density of the cyan patch image on the intermediate transfer belt 6. The measurement values of the density detection sensor 5 are converted into a density value by the aforementioned sequence.

In step S112, the CPU 614 compares the density value of the cyan patch image with a reference density value, and calculates a color density difference ΔC from the reference density value.

The CPU 614 determines in step S113 based on the color differences whether or not the multinary-color density adjustment is required. For example, the CPU 614 calculates a total color difference ΔE, and determines whether or not the color difference ΔE is equal to or larger than a prescribed value.

$$\Delta E=\sqrt{(\Delta Y\cdot\Delta Y+\Delta M\cdot\Delta M+\Delta C\cdot\Delta C)}$$

The prescribed value is, for example, "3". This is because ΔE≤3 is used to check a Class-A allowable difference designated by Japan Color Research Institute, that is, a color difference that one nearly cannot perceive. However, the prescribed value of ΔE is an arbitrary value in terms of the design of the image forming apparatus 100. This is because the prescribed value of ΔE is a value which should be decided according to the required quality of the image forming apparatus 100. If ΔE≥3, since one can visibly confirm the multinary-color tint variations, the CPU 614 determines that the multinary-color density adjustment is required. In this case, the process advances to step S114. In this manner, the CPU 614 functions as a determination unit which determines that density adjustment for the color material of the first color forming the multinary-color is required, when a color difference obtained from the density, detected by the density detection unit, of the patch image using the color material of the first color becomes equal to or larger than a threshold For example, when a multinary-color is formed by the magenta and the yellow, and the difference is larger than the threshold, the CPU 614 determines that the adjustment of the yellow is required at least. The adjustment of the magenta may be conducted.

In step S114, the CPU 614 outputs a message indicating that the multinary-color density adjustment is required to the user via the display device of the operation unit 616 or the like. When the user inputs a start instruction of the multinary-color density adjustment via the input device of the operation unit 616, the CPU 614 starts the multinary-color density adjustment. Note that the CPU 614 may start the multinary-color density adjustment without waiting for a user instruction. If ΔE<3, the CPU 614 determines that the multinary-color density adjustment is not required, and ends the processing according to this flowchart.

According to this embodiment, when the CPU 614 determines whether or not the density adjustment is required for the color material of the first color, it configures a transfer potential required to execute an image forming job to be the first transfer potential, and configures a transfer potential which does not cause any retransfer phenomenon of the patch image of the first color in the second transfer unit to be the second transfer potential. In this way, since the influence of the retransfer phenomenon can be eliminated, the CPU 614 can precisely determine whether or not the multinary-color density adjustment is required.

According to FIG. 10, the CPU 614 executes the single-color density adjustment, and then recognizes the applied toner amount of a toner formed as a lower layer upon forming a multinary color. When the CPU 614 determines that the multinary-color density adjustment is required, it outputs a message that suggests the necessity of the multinary-color density adjustment to the user, and starts the multinary-color density adjustment.

<Multinary-Color Density Adjustment>

The multinary-color density adjustment to be executed in this embodiment will be described below. The multinary-color density adjustment to be executed in this embodiment is mainly executed by the image processor 611.

Figure 14:
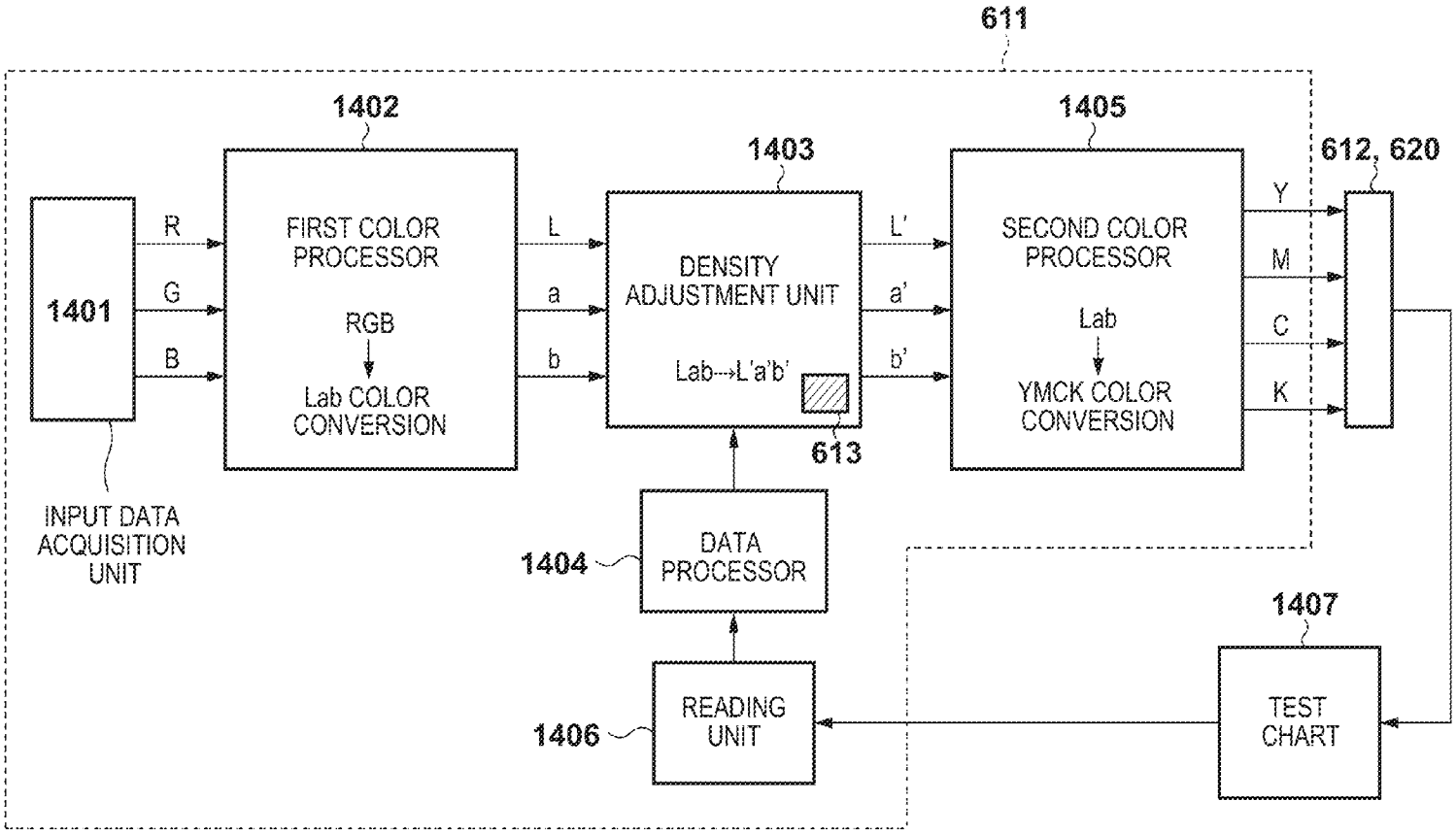
FIG. 14 is a block diagram showing blocks required to execute multinary-color density adjustment.

FIG. 14 is a block diagram showing a density adjustment function in the image processor 611. An input data acquisition unit 1401 acquires image data attached to a print job. The image data includes R, G, and B color data. A first color processor 1402 converts the R, G, and B color data into L, a, and b color data expressed on an Lab (more correctly, L*, a*, and b*) color space. A density adjustment unit 1403 executes density adjustment for the color data (L, a, b) output from the first color processor 1402, and outputs color data (L', a', b') to a second color processor 1405. The second color processor 1405 converts the color data (L', a', b') output from the density adjustment unit 1403 onto a color space (YMCK) handled by the engine controller 612.

A reading unit 1406 serves as a reading unit which reads a patch image which is formed on a printing medium by the image forming apparatus 100 and uses the color material of the first color. More specifically, the reading unit 1406 reads a test chart 1407 output by the engine 620, and outputs the read data to a data processor 1404. The data processor 1404 converts the data read by the reading unit 1406 into Lab data.

Figure 15:
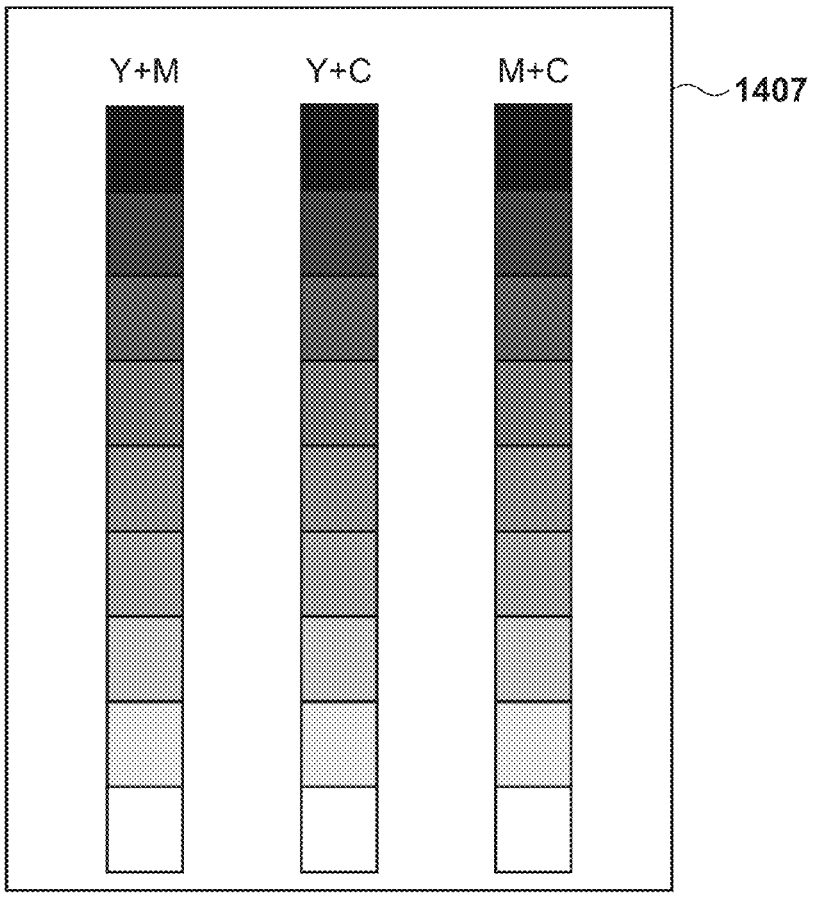
FIG. 15 shows a test chart for multinary-color density adjustment.

When the CPU 614 determines that the multinary-color density adjustment is required, it controls the patch generator to generate image data of patch images of multinary colors shown in FIG. 15, and passes them to the input data acquisition unit 1401. Furthermore, the CPU 614 controls the engine 620 to output the patch images of the multinary colors shown in FIG. 15 onto the printing medium P, thus creating the test chart 1407. In this case, the CPU 614 configures the transfer potential used upon execution of an image forming job as the first and second transfer potentials. That is, the CPU 614 configures the transfer potential Vn in all of the primary transfer units 7Y, 7M, 7C, and 7K. Thus, the image forming apparatus 100 creates the test chart 1407 as patch images using the color material of the first color on the printing medium.

The reading unit 1406 reads the densities of the respective patch images on the test chart 1407, and outputs color data R, G, and B expressed on an RGB color space. The data processor 1404 maps the color data R, G, and B expressed on the RGB color space onto the Lab color space, thus recognizing chromaticity points.

The density adjustment unit 1403 compares the read data output from the data processor 1404 and the input data (image data of the patch images) output from the first processor 1402. The density adjustment unit 1403 adjusts the input data (Lab) to minimize a color difference between the two data. That is, the data processor 1404 reads the density of the patch image formed on the printing medium P, and creates a multinary-color density adjustment table used to adjust the density of the patch image to a target density. Then, the density adjustment unit 1403 adjusts the density of an input image using the multinary-color density adjustment table in image formation using the first color as a lower layer color of a multinary color.

Figure 16:
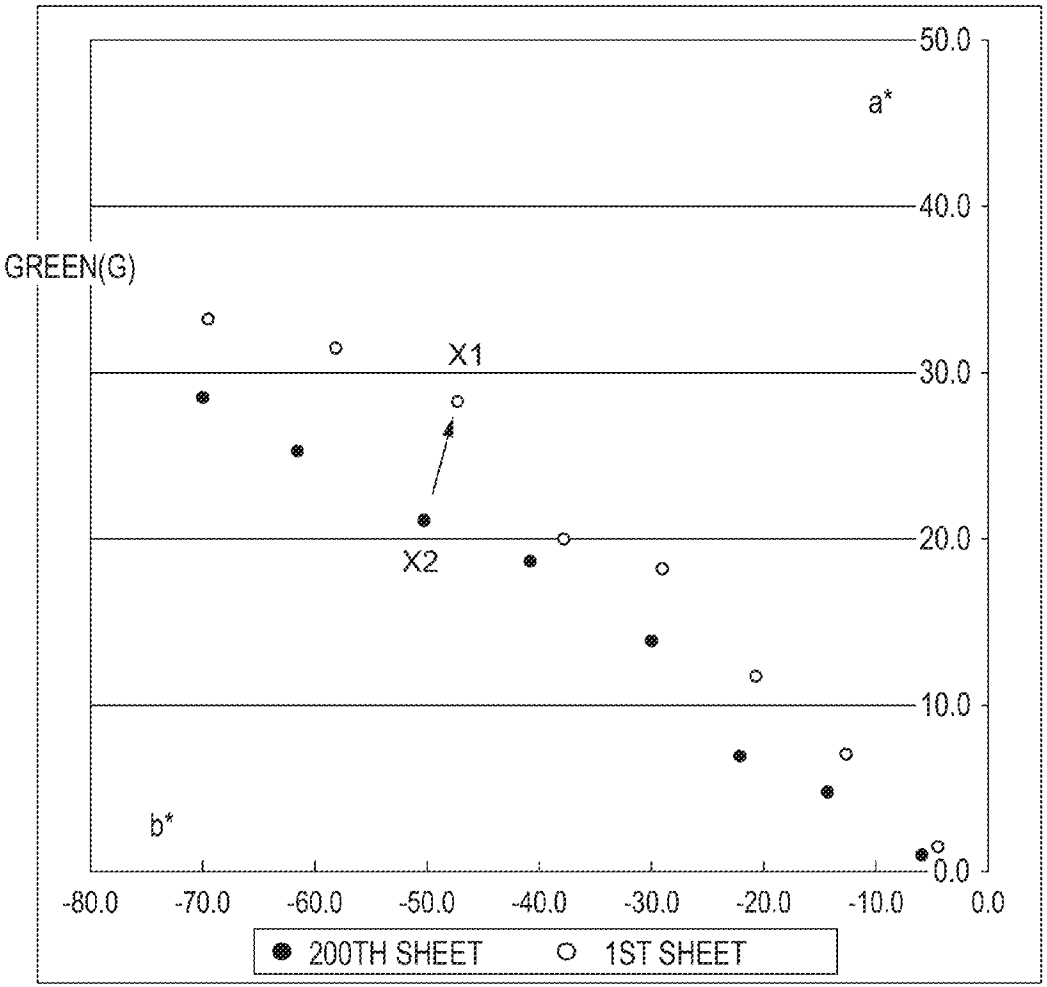
FIG. 16 is a graph showing an example of multinary color density variations.

FIG. 16 shows green chromaticity points X1 and X2 on the first sheet (reference) and 200th sheet when a low-density image is continuously output. In FIG. 16, since the low-density image is continuously output, the toner charge amount and retransfer amount change, and green chromaticity points on the first and 200th sheets change.

The density adjustment unit 1403 adjusts the density of the chromaticity point X2 so that the green chromaticity point X2 on the 200th sheet matches the green chromaticity point X1 on the first sheet. More specifically, the density adjustment unit 1403 compares an Lab value of the point X2 with that of the point X1, and calculates an adjustment value so that these Lab values assume the same value. After that, the density adjustment unit 1403 adjusts input data using this adjustment value.

<Confirmation of Effect>

In order to confirm the technical effects of this embodiment, productivity (user load) upon continuously outputting a low-density image on 1000 sheets was verified. In this embodiment, the CPU 614 executes single-color density adjustment every 100 sheets. As a comparative example, after the single-color density adjustment was executed every 100 sheets, patch images were output onto the printing medium P and the multinary-color density adjustment was executed. In this embodiment, the necessity of the multinary-color density adjustment was checked in synchronism with the single-color density adjustment every 100 sheets, and the multinary-color density adjustment was executed only when the necessity was determined.

As a result, in this embodiment, it was determined every about 200 sheets that the multinary-color density adjustment was required, and the multinary-color density adjustment was executed. That is, in this embodiment, by determining every 100 sheets whether the execution of the multinary-color density adjustment is necessary, it was determined that the multinary-color density adjustment was not required in some cases.

In the comparative example, the multinary-color density adjustment was executed 10 times (every 100 sheets) when 1000 sheets were output. In this embodiment, the multinary-color density adjustment was executed about five times (every 200 sheets). Hence, compared to the comparative example, this embodiment can reduce the number of execution times of the multinary-color density adjustment. As a result, as can be seen from the above description, this embodiment not only can improve the productivity but also can provide a user load reduction effect. Since the number of execution times of the multinary-color density adjustment can be reduced, consumption amounts of toners and printing media P can also be reduced.

Figure 17:
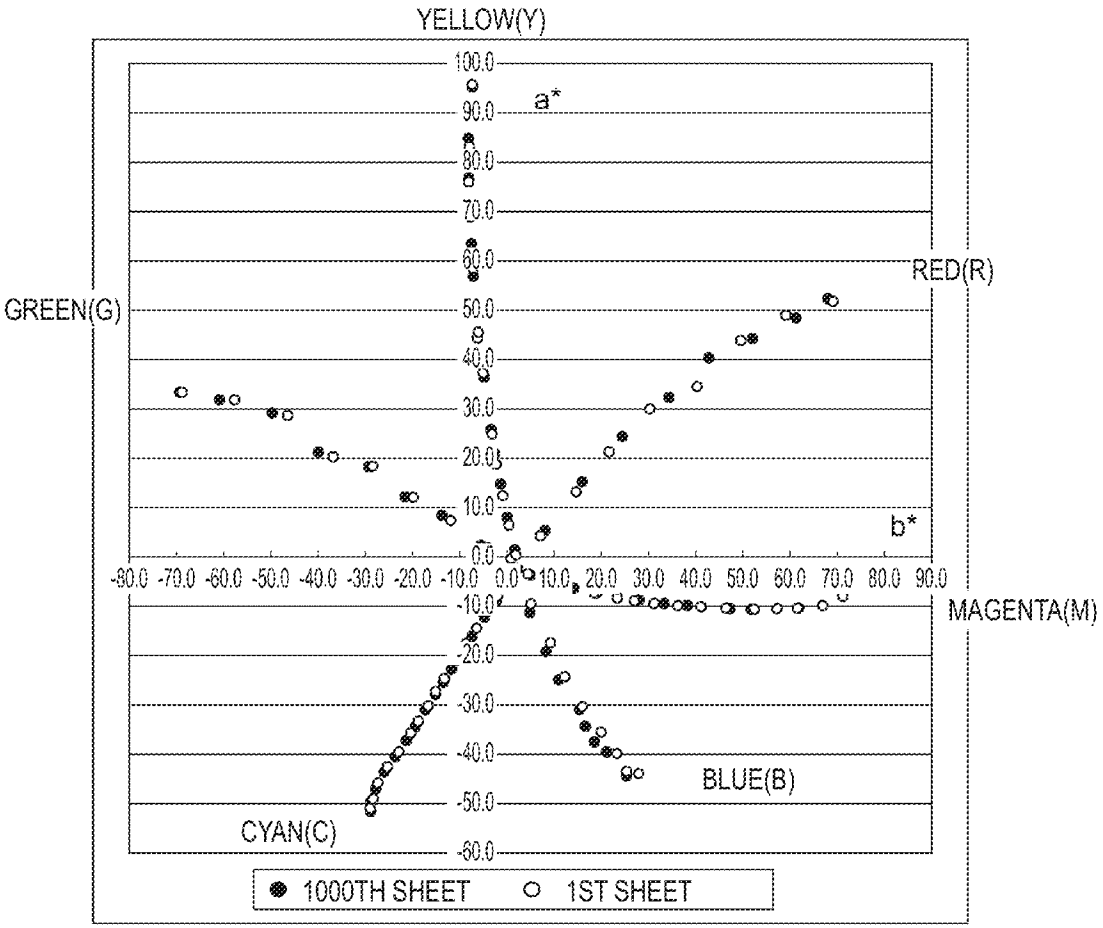
FIG. 17 is a graph showing an output result after the multinary-color density adjustment.

FIG. 17 shows differences of Y, M, C, K, R, G, and B chromaticity points between the first and 1000th sheets when this embodiment is adopted. In this embodiment, as can be seen from FIG. 17, differences between the first and 1000th sheets can be sufficiently reduced, and image quality can also be maintained.

<Others>

In this embodiment, not only the single-color density adjustments of yellow, magenta, cyan, and black but also the multinary-color density adjustment are executed using the density detection results of toners that have not been fixed. Note that by omitting the determination of whether or not the multinary-color density adjustment is necessary, toner consumption amounts required for that determination can be reduced.

Figure 18:
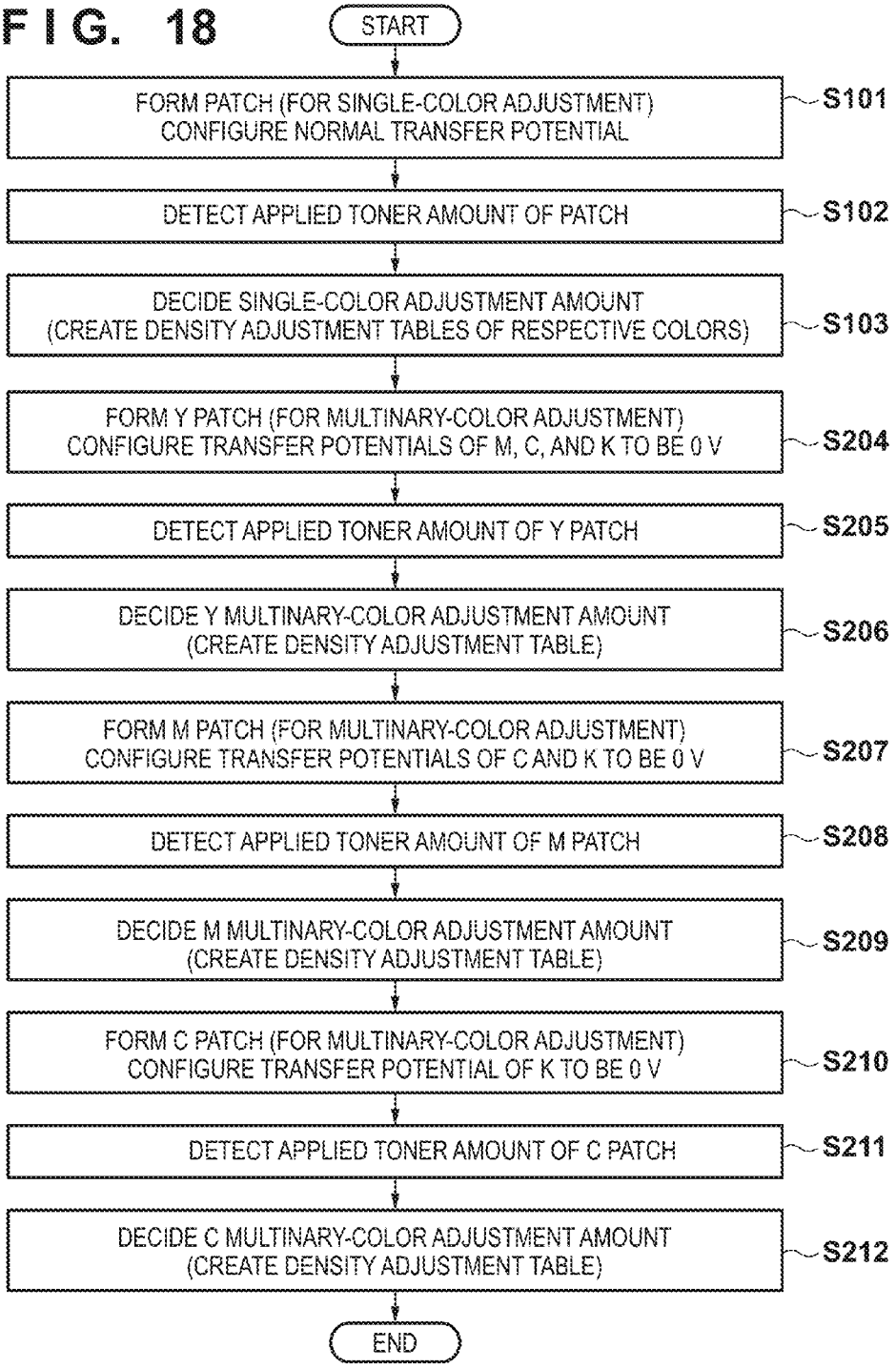
FIG. 18 is a flowchart showing density adjustment processing without using any printing medium.

FIG. 18 is a flowchart showing density adjustment according to this embodiment. The same step numbers denote the same processes which have already been described to simplify the following description. In steps S101 to S103, the CPU 614 executes single-color density adjustment. Thus, a density adjustment table for single-color image formation is created, and is stored in the storage unit 613. After that, the process advances to step S204.

In step S204, the CPU 614 controls the patch generator 615 to generate image data of a yellow patch image, and passes it to the exposure device 3Y of the engine 620. The patch image is as shown in FIG. 8. The CPU 614 configures the normal transfer potential Vn in the yellow primary transfer unit 7Y, and configures the transfer potential V0 in the magenta, cyan, and black primary transfer units 7M, 7C, and 7K on the downstream side of the yellow primary transfer unit. The transfer potential V0 is, for example, 0 volt. As a characteristic feature in this case, toner images of a multinary color are not formed on the intermediate transfer belt 6.

In step S205, the CPU 614 controls the density detection sensor 5 to detect the density of the yellow patch image on the intermediate transfer belt 6. The measurement values of the density detection sensor 5 are converted into a density value by the aforementioned sequence.

In step S206, the CPU 614 calculates a correction value required to adjust the density value of the yellow patch image to a reference density value, creates a yellow density adjustment table used in multinary-color image formation, and stores that table in the storage unit 613. The creation method of the multinary-color density adjustment table is basically the same as that of the single-color density adjustment table. In this way, the CPU 614 functions as a creation unit which compares a density, detected by the density detection sensor 5, of a patch image using the color material of the first color with a target density, and creates a multinary-color density adjustment table used to adjust the density of the patch image to the target density.

In step S207, the CPU 614 controls the patch generator 615 to generate image data of a magenta patch image, and passes it to the exposure device 3M of the engine 620. The patch image is as shown in FIG. 8. The CPU 614 configures the normal transfer potential Vn in the magenta primary transfer unit 7M, and configures the transfer potential V0 in the cyan and black primary transfer units 7C and 7K on the downstream side of the magenta primary transfer unit. The transfer potential V0 is, for example, 0 volt.

In step S208, the CPU 614 controls the density detection sensor 5 to detect the density of the magenta patch image on the intermediate transfer belt 6. The measurement values of the density detection sensor 5 are converted into a density value by the aforementioned sequence.

In step S209, the CPU 614 calculates a correction value required to adjust the density value of the magenta patch image to a reference density value, creates a magenta density adjustment table used in multinary-color image formation, and stores that table in the storage unit 613. In this way, the CPU 614 functions as a creation unit which compares a density, detected by the density detection sensor 5, of a patch image using the color material of the first color with a target density, and creates a multinary-color density adjustment table used to adjust the density of the patch image to the target density.

In step S210, the CPU 614 controls the patch generator 615 to generate image data of a cyan patch image, and passes it to the exposure device 3C of the engine 620. The patch image is as shown in FIG. 8. The CPU 614 configures the normal transfer potential Vn in the cyan primary transfer unit 7C, and configures the transfer potential V0 in the black primary transfer unit 7K on the downstream side of the cyan primary transfer unit. The transfer potential V0 is, for example, 0 volt.

In step S211, the CPU 614 controls the density detection sensor 5 to detect the density of the cyan patch image on the intermediate transfer belt 6. The measurement values of the density detection sensor 5 are converted into a density value by the aforementioned sequence.

In step S212, the CPU 614 calculates a correction value required to adjust the density value of the cyan patch image to a reference density value, creates a cyan density adjustment table used in multinary-color image formation, and stores that table in the storage unit 613. In this way, the CPU 614 functions as a creation unit which compares a density, detected by the density detection sensor 5, of a patch image using the color material of the first color with a target density, and based on the result of this comparing, creates a multinary-color density adjustment table used to adjust the density of the patch image to the target density. When the image forming apparatus 100 forms a multinary-color image using the first color as a lower layer color, it converts a density of an input image using the multinary-color density adjustment table to form the multinary-color image.

According to this embodiment, by controlling a transfer potential of an image forming unit which is located on the downstream side of an image forming unit which forms a patch image, an applied toner amount free from the influence of any retransfer phenomenon is recognized. This is because the applied toner amount of a lower layer color upon formation of a multinary color is not easily influenced by the retransfer phenomenon.

According to this embodiment, the single-color density adjustment and the multinary-color density adjustment are executed at the same timing, but these adjustments may be executed at different timings. For example, every time the CPU 614 executes the single-color density adjustment twice, it may execute the multinary-color density adjustment once. This ratio may be decided in advance by simulations or experiments at a factory delivery timing. In this embodiment, since the determination of the necessity of multinary-color density adjustment is omitted, toner consumption amounts required for that determination can be reduced.

Experiments were conducted to confirm the effects of this embodiment. That is, when an image having a density of 5% was continuously output onto 1000 sheets, Y, M, C, K, R, G, and B chromaticity points of the first and 1000th sheets were roughly the same. As described above, according to this embodiment, since the multinary-color density adjustment can be executed without using any printing media, consumption amounts of printing media can be suppressed compared to the conventional apparatus. Also, since the user's determination step as to whether or not the multinary-color density adjustment is required can be omitted, the load on the user can be reduced compared to the conventional apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-168712, filed Aug. 1, 2011, which is hereby incorporated by reference herein in its entirety.

What is claimed is:

1. An image forming apparatus comprising:

a correction unit configured to correct image data based on tone correction condition;

a first image forming unit configured to form a first image using a color material of a first color on a first image carrier based on the image data corrected by the correction unit;

a second image forming unit configured to form a second image using a color material of a second color different from the first color on a second image carrier based on the image data corrected by the correction unit;

a first transfer unit configured to transfer the first image formed on the first image carrier to an intermediate transfer body;

a second transfer unit located on a downstream side of the first transfer unit in a conveying direction of the intermediate transfer body, configure to transfer a second image formed on a second image carrier to the intermediate transfer body;

a setting unit configured to set a transfer potential to be applied to the second transfer unit;

a density detection unit located on the downstream side of the second transfer unit in the conveying direction of the intermediate transfer body, configured to detect a density of a first measurement image, a density of a second measurement image, the first measurement image being formed by the first image forming unit and being transfer to the intermediate transfer body by the first transfer unit, the second measurement image being formed by the second image forming unit and being transfer to the intermediate transfer body by the second transfer unit;

a first creation unit configured to create the tone correction condition based on a detection result of the density detection unit;

a converting unit configured to convert the image data to be corrected by the correction unit based on a multinary-color density adjustment table in a case where a multinary-color image is formed using the color material of the first color and the color material of the second color;

a reading unit configured to read a test image formed on a printing medium by the image forming apparatus, the test image being formed using the color material of the first color and the color material of the second color;

a determination unit configured to determine whether the multinary-color density adjustment table should be created based on a density of a third measurement image and a density of a fourth measurement image, the third measurement image being a measurement image of the first color formed on the intermediate transfer body, and the fourth measurement image being a measurement image of the second color formed on the intermediate transfer body; and a second creation unit configured to create the multinary-color density adjustment table based on a reading result of the test image by the reading unit, in a case where the determination unit determines that the multinary-color density adjustment table should be created, wherein when the second creation unit creates the multinary-color density adjustment table, the setting unit sets the transfer potential to be applied to the second transfer unit to a transfer potential which prevents the third measurement image transferred by the first transfer unit from being retransferred to the second image carrier.

2. The apparatus according to claim 1, wherein the determination unit is further configured to determine that the multinary-color density adjustment table should be created in a case where a sum of a difference between a reference density and a density of the third measurement image detected by the density detection unit and a difference between an another reference density and a density of the fourth measurement image detected by the density detection unit is larger than a threshold value.

3. The apparatus according to claim 1, wherein, the transfer potential which prevents the third image transferred by the first transfer unit from being retransferred to the second image carrier is 0 volt.

4. An image forming apparatus including a correction unit configured to correct image data based on tone correction condition and an image forming unit configured to form an image on printing medium based on the image data corrected by the correction unit, the image forming unit comprising:

an image carrier configured to carry and convey an image;

a first image forming unit configured to form a first image using a color material of a first color on the image carrier based on a first transfer potential;

a second image forming unit located on a downstream side of the first image forming unit in a conveying direction of the image carrier, configure to form a second image using a color material of a second color different from the first color on the image carrier based on a second transfer potential, the image forming apparatus further comprising:

a controller configured to control the first transfer potential and the second transfer potential;

a measuring unit located on the downstream side of the second image forming unit in the conveying direction of the image carrier, configured to measure a measuring image formed on the image carrier by the image forming unit;

a creation unit configured to create a tone correction condition for the first image based on a measuring result of a first measuring image corresponding to the first color by the measuring unit, and create a tone correction condition for the second image based on a measuring result of a second measuring image corresponding to the second color by the measuring unit;

a converting unit configured to convert the image data to be corrected by the correction unit based on converting condition in a case where a multinary-color image is formed using the color material of the first color and the color material of the second color; and a determination unit configured to determine whether the converting condition should be updated based on a measuring result of a third measuring image, wherein, while the third measuring image formed by the first image forming unit is passing through the second image forming unit, the control unit controls the second transfer potential so that a retransfer of the third measuring image to the second image forming unit is prevented.

5. The image forming apparatus according to claim 4, further comprising a notifying unit configured to notify that update of the converting condition is required in a case where the determination unit determines that the converting condition should be updated.

6. The image forming apparatus according to claim 4, further comprising a reading unit configured to read a test image, and an updating unit configured to update the converting condition based on a reading result of the test image by the reading unit, wherein the image forming unit forms the test image by overlapping the first color and the second color in a case where the determination unit determines that the converting condition should be updated.

7. The image forming apparatus according to claim 4, wherein the third measuring image includes a measuring image of the first color and a measuring image of the second color, and wherein the determination unit determines that the converting condition should be updated in a case where a sum of a difference between a first reference measuring result for the first color and a measuring result of the measuring image of the first color and a difference between a second reference measuring result for the second color and a measuring result of the measuring image of the second color is larger than a threshold value.

8. The image forming apparatus according to claim 4, wherein converting unit converts a density characteristic of the image data based on the converting condition in a case where the image forming unit forms a image using a color material of the first color and a color material of the second color.

* * * * *